US011044998B1

(12) United States Patent
Garcia

(10) Patent No.: US 11,044,998 B1
(45) Date of Patent: Jun. 29, 2021

(54) FOLDABLE STADIUM SEAT AND COOLER APPARATUS

(71) Applicant: James Garcia, San Antonio, TX (US)

(72) Inventor: James Garcia, San Antonio, TX (US)

( * ) Notice: Subject to any disclaimer, the term of this patent is extended or adjusted under 35 U.S.C. 154(b) by 0 days.

(21) Appl. No.: 16/854,526

(22) Filed: Apr. 21, 2020

(51) Int. Cl.

| | |
|---|---|
| ***A47C 1/16*** | (2006.01) |
| ***A47C 7/62*** | (2006.01) |
| ***B65D 81/18*** | (2006.01) |
| ***A47C 7/40*** | (2006.01) |

(52) U.S. Cl.
CPC ..... *A47C 1/16* (2013.01); *A47C 7/407* (2013.01); *A47C 7/626* (2018.08); *B65D 81/18* (2013.01)

(58) Field of Classification Search
CPC ..... A47C 7/407; A47C 7/626; A47C 7/72; A47C 1/16
USPC .... 297/144, 188.08, 188.11, 188.12, 188.13, 297/188.2, 217.7, 252, 352, 378.1
See application file for complete search history.

(56) References Cited

U.S. PATENT DOCUMENTS

| | | | | |
|---|---|---|---|---|
| 413,733 | A | 10/1889 | Richards | |
| 3,560,047 | A * | 2/1971 | Davis | A47C 7/62 297/188.08 |
| 3,994,529 | A * | 11/1976 | Lippert | A47C 1/16 297/252 |
| 4,556,250 | A | 12/1985 | Chapman | |
| 5,050,767 | A | 9/1991 | Peer | |
| 5,100,198 | A | 3/1992 | Baltzell | |
| D330,639 | S | 11/1992 | Munro | |
| 6,390,551 | B1 | 5/2002 | Hendrickson | |
| 7,128,369 | B2 | 10/2006 | Boggs | |
| 8,011,194 | B2 | 9/2011 | Dimmitt | |

FOREIGN PATENT DOCUMENTS

| | | | |
|---|---|---|---|
| DE | 9415326 U1 * | 1/1995 | A47C 7/626 |
| WO | WO2014074098 | 5/2014 | |

* cited by examiner

*Primary Examiner* — Robert Canfield

(57) ABSTRACT

A foldable stadium seat and cooler apparatus for comfortable and convenient seating and beverage storage includes a cooler housing having a cooler drawer to store ice and beverages. A pair of leg receptacles is coupled to the cooler top side. Each of a pair of chair legs has a lower attachment portion, a riser portion, and a support portion. The lower attachment portion is selectively engageable with the pair of leg receptacles. The pair of chair legs receives a stadium bench or seat between the lower attachment portion and the support portion of each chair leg. A chair bottom is coupled to the support portion of each chair leg and a chair back is coupled to the pair of chair legs.

11 Claims, 5 Drawing Sheets

FOLDABLE STADIUM SEAT AND COOLER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to recreational seating devices and more particularly pertains to a new recreational seating device for comfortable and convenient seating and beverage storage.

(2) DESCRIPTION OF RELATED ART INCLUDING INFORMATION DISCLOSED UNDER 37 CFR 1.97 AND 1.98.

The prior art relates to recreational seating devices for stadiums and incorporated coolers.

BRIEF SUMMARY OF THE INVENTION

An embodiment of the disclosure meets the needs presented above by generally comprising a cooler housing having a cooler top side, a cooler bottom side, a cooler left side, a cooler right side, a cooler back side, and an open cooler front side defining a cooler inside. A cooler drawer is coupled to the cooler housing. The cooler drawer has a tray portion slidably engaged within the cooler inside and a cooler drawer face to selectively cover and uncover the open cooler front side. The cooler drawer is configured to store ice and beverages. A pair of leg receptacles is coupled to the cooler top side. Each of a pair of chair legs has a lower attachment portion, a riser portion, and a support portion. The lower attachment portion is selectively engageable with the pair of leg receptacles. The pair of chair legs is configured to slidably receive a stadium bench or seat between the lower attachment portion and the support portion of each chair leg. A chair bottom is coupled to the support portion of each chair leg and a chair back is coupled to the pair of chair legs.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
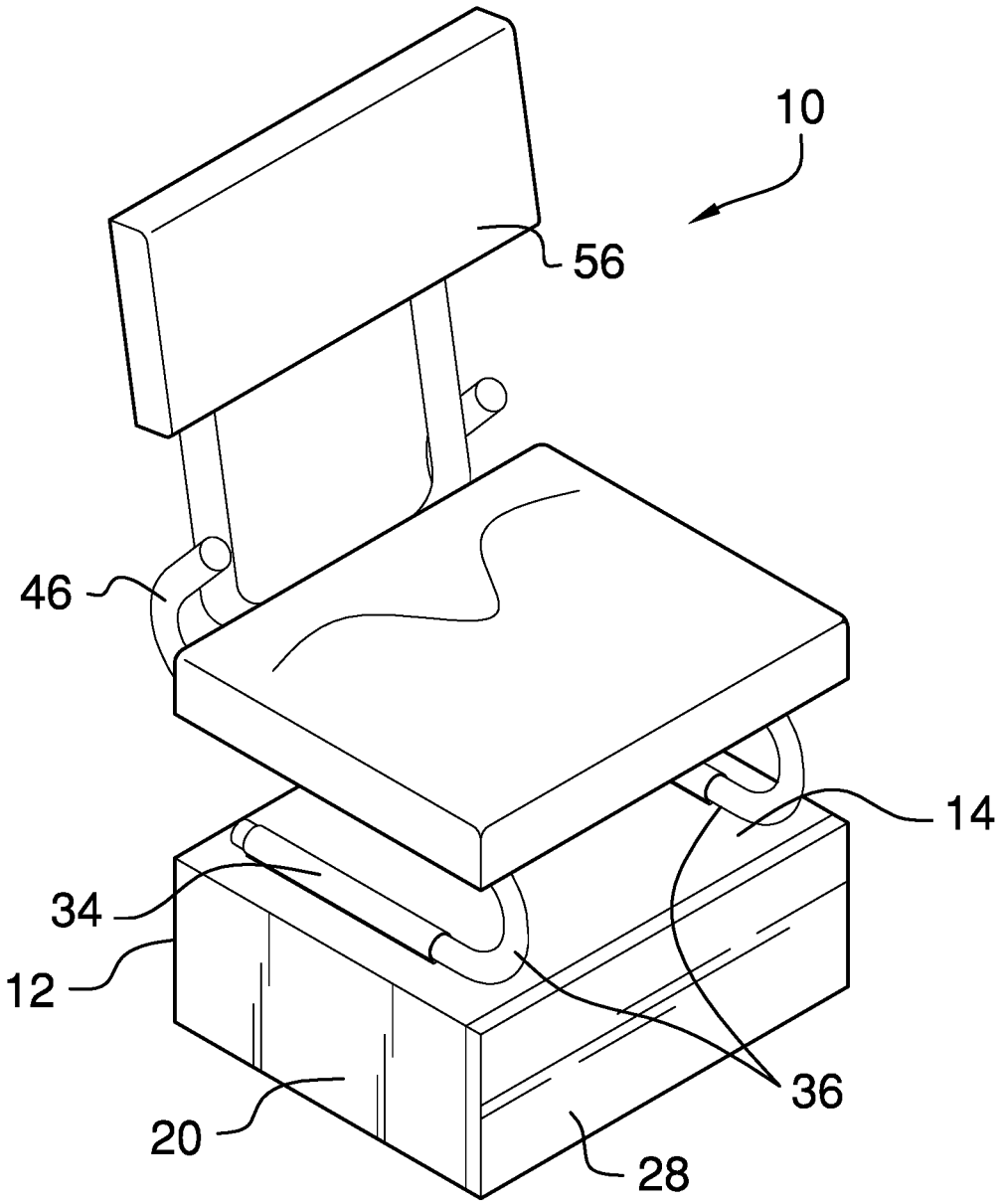
FIG. 1 is an isometric view of a foldable stadium seat and cooler apparatus according to an embodiment of the disclosure.
Figure 2:
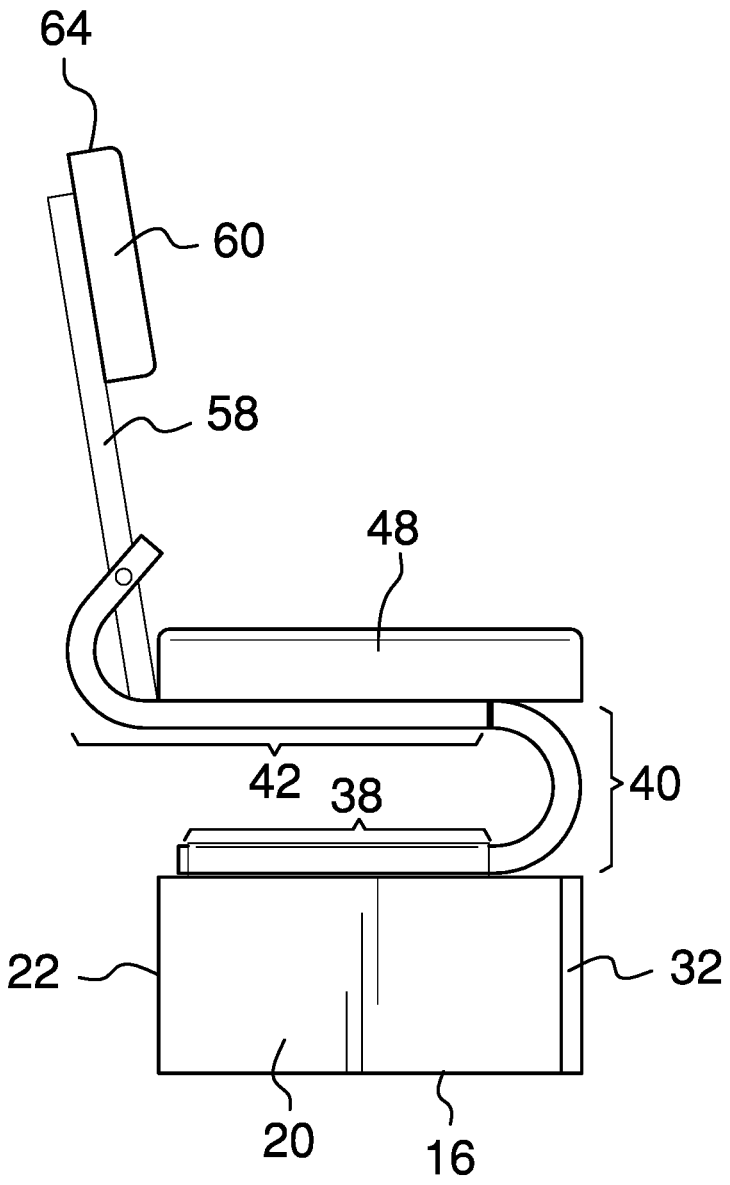
FIG. 2 is a side elevation view of an embodiment of the disclosure.
Figure 3:
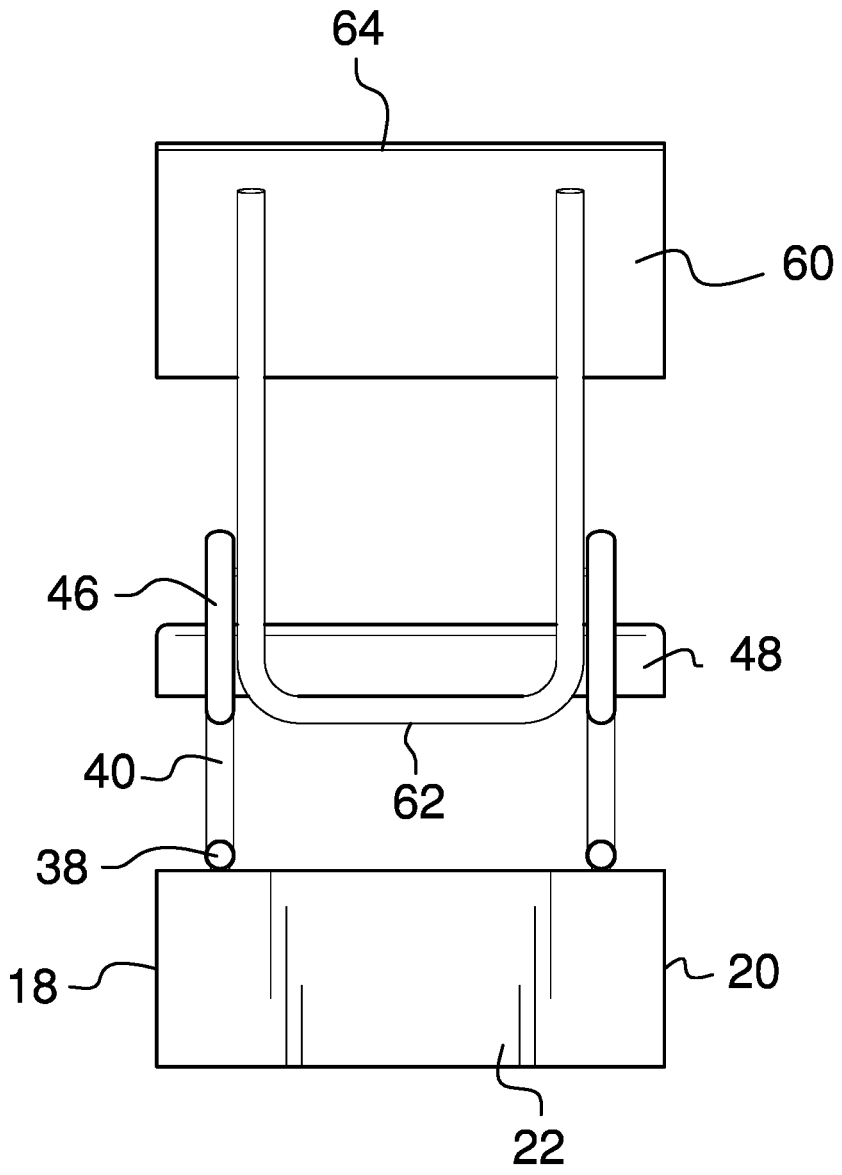
FIG. 3 is a rear elevation view of an embodiment of the disclosure.
Figure 4:
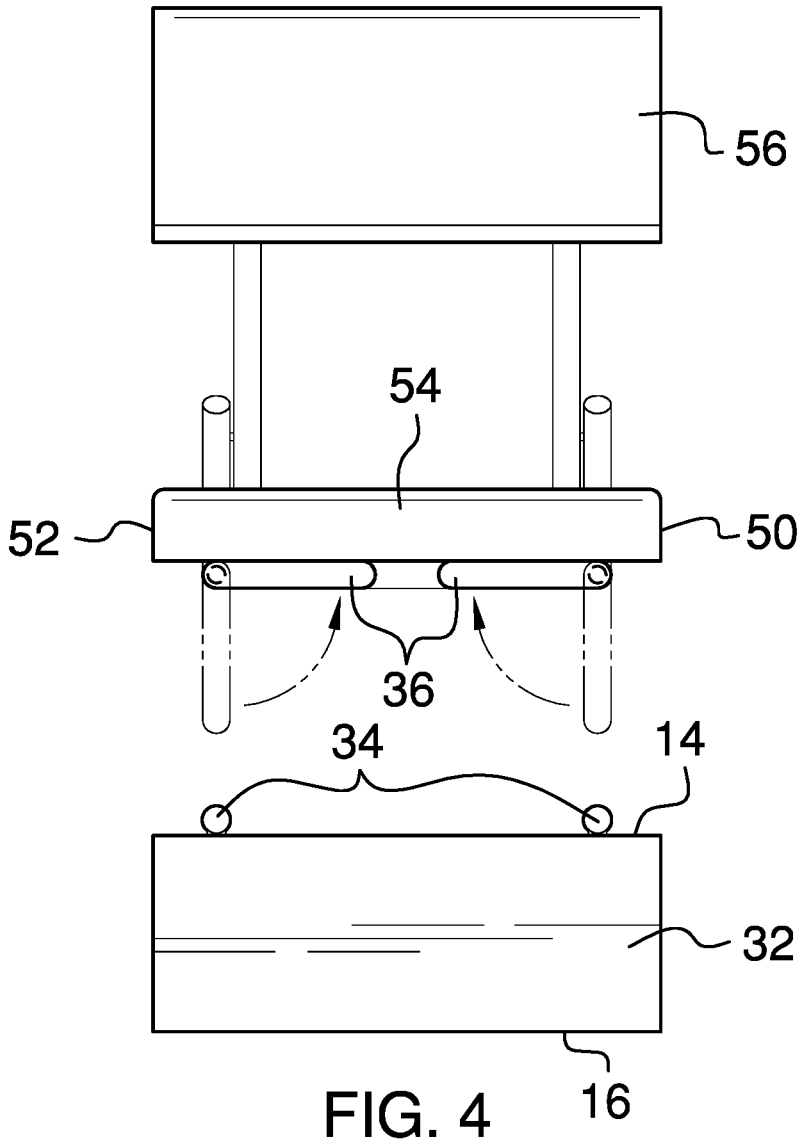
FIG. 4 is a front elevation view of an embodiment of the disclosure.
Figure 5:
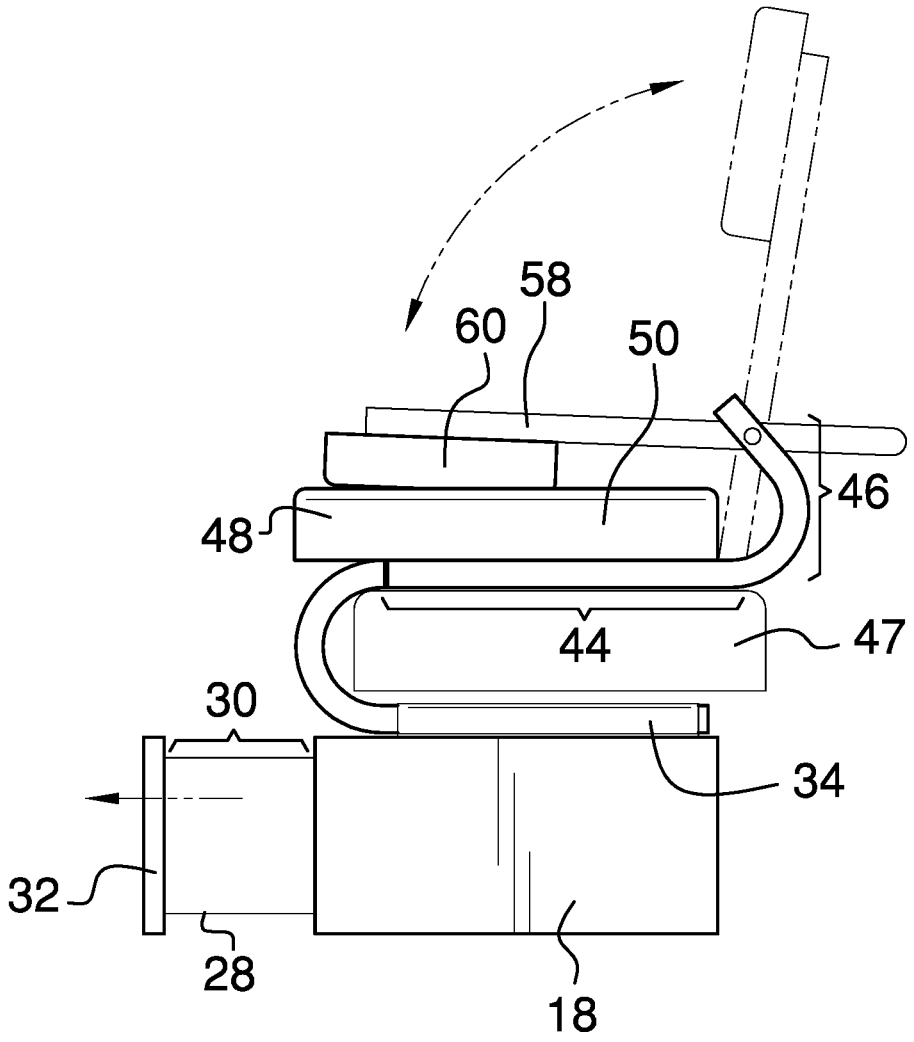
FIG. 5 is a side elevation view of an embodiment of the disclosure.

With reference now to the drawings, and in particular to FIGS. 1 through 5 thereof, a new recreational seating device embodying the principles and concepts of an embodiment of the disclosure and generally designated by the reference numeral 10 will be described.

As best illustrated in FIGS. 1 through 5, the foldable stadium seat and cooler apparatus 10 generally comprises a cooler housing 12 having a cooler top side 14, a cooler bottom side 16, a cooler left side 18, a cooler right side 20, a cooler back side 22, and an open cooler front side 24 defining a cooler inside 26. A cooler drawer 28 is coupled to the cooler housing 12. The cooler drawer 28 has a tray portion 30 slidably engaged within the cooler inside 26 and a cooler drawer face 32 to selectively cover and uncover the open cooler front side 24. The cooler drawer 28 is configured to store ice and beverages. The cooler housing 12 and the cooler drawer face 32 may each comprise an outer hard shell and inner insulating layer.

A pair of leg receptacles 34 is coupled to the cooler top side 14. Each leg receptacle 34 of the pair of leg receptacles may be tubular and oriented parallel to the cooler left side 18 and the cooler right side 20. Each of a pair of chair legs 36 has a lower attachment portion 38, a riser portion 40, and a support portion 42. The lower attachment portion 38 is horizontal and slidingly engageable within the pair of leg receptacles 34. Each leg receptacle 34 may alternatively be slotted and flexible to allow the lower attachment portion 38 to snap into place.

The riser portion 40 may be U-shaped or semicircular and pivotably coupled to the support portion 42. The riser portion 40 and the lower attachment portion 38 of each chair leg thus may move between a vertical use position and a horizontal store position. The movement of each chair leg 36 is restricted to fold in towards the opposite chair leg 36 to create stability when the pair of chair legs 36 is engaged within the pair of leg receptacles 34. The support portion 42 may include a horizontal base section 44 and a back support section 46. The pair of chair legs 36 in the use position is configured to slidably receive a stadium bench 47 or seat between the lower attachment portion 38 and the base section 44 of the support portion of each chair leg.

A chair bottom 48 is coupled to the pair of chair legs 36. The chair bottom 48 is coupled to the base section 44 of the support portion of each chair leg. The chair bottom 48 may be cushioned for user comfort and may have a cushion left side 50 and a cushion right side 52 extending past the base section 44 and a cushion front side 54 extending over the riser portion 40. A chair back 56 is coupled to the pair of chair legs 36. The chair back 56 may have a back frame 58 pivotably coupled to the back support section 46 of the support portion 42 of each chair leg and a back rest 60 coupled to the back frame 58. The chair back 56 moves between an upright position and a folded position adjacent the chair bottom 48. The back support section 46 may form an acute angle with the horizontal base section 46 and the back frame 58 may be a squared U-shape. A lower bar 62 of the back frame may contact the chair bottom 48 in the upright position to limit the range of motion. The back rest 60 may be cushioned and a rest top side 64 may extend above the back frame 58. The back rest 60 may contact the chair bottom 48 in the folded position.

In use, the cooler drawer 28 is loaded with ice and beverages of the user's choice. Once at the stadium bench 47 or seat the pair of chair legs 36 are folded out to the use position and the lower attachment portion 38 of each chair leg is engaged within the pair of leg receptacles 34. The cooler housing 12 is then slid beneath the stadium bench 47 or seat with the stadium bench 47 or seat between the lower attachment portion 38 and the base section 44. The chair back 56 is folded to the upright position and the apparatus 10 is then used as a traditional seat. The cooler drawer 28 is opened to retrieve beverages as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A foldable stadium seat and cooler apparatus comprising:

a cooler housing having a cooler top side, a cooler bottom side, a cooler left side, a cooler right side, a cooler back side, and an open cooler front side defining a cooler inside;

a cooler drawer coupled to the cooler housing, the cooler drawer having a tray portion slidably engaged within the cooler inside and a cooler drawer face selectively covering and uncovering the open cooler front side, the cooler drawer being configured to store ice and beverages;

a pair of leg receptacles coupled to the cooler top side;

a pair of chair legs, each chair leg having a lower attachment portion, a riser portion, and a support portion, the lower attachment portion being selectively engageable with the pair of leg receptacles, the pair of chair legs being configured to slidably receive a stadium bench or seat between the lower attachment portion and the support portion of each chair leg;

a chair bottom coupled to the pair of chair legs, the chair bottom being coupled to the support portion of each chair leg; and a chair back coupled to the pair of chair legs.

2. The foldable stadium seat and cooler apparatus of claim 1 further comprising each leg receptacle of the pair of leg receptacles being tubular and oriented parallel to the cooler left side and the cooler right side.

3. The foldable stadium seat and cooler apparatus of claim 1 further comprising the lower attachment portion being horizontal and the riser portion being U-shaped.

4. The foldable stadium seat and cooler apparatus of claim 3 further comprising the riser portion being semicircular.

5. The foldable stadium seat and cooler apparatus of claim 3 further comprising the riser portion being pivotably coupled to the support portion and moving between a vertical use position and a horizontal store position.

6. The foldable stadium seat and cooler apparatus of claim 1 further comprising the support portion including a horizontal base section and a back support section.

7. The foldable stadium seat and cooler apparatus of claim 6 further comprising the back support section forming an acute angle with the horizontal base section.

8. The foldable stadium seat and cooler apparatus of claim 6 further comprising the chair back having a back frame pivotably coupled to the back support section of the support portion and a back rest coupled to the back frame, the chair back moving between an upright position and a folded position adjacent the chair bottom.

9. The foldable stadium seat and cooler apparatus of claim 8 further comprising the back frame being a squared U-shape.

10. A foldable stadium seat and cooler apparatus comprising:

a cooler housing having a cooler top side, a cooler bottom side, a cooler left side, a cooler right side, a cooler back side, and an open cooler front side defining a cooler inside;

a cooler drawer coupled to the cooler housing, the cooler drawer having a tray portion slidably engaged within the cooler inside and a cooler drawer face selectively covering and uncovering the open cooler front side, the cooler drawer being configured to store ice and beverages;

a pair of leg receptacles coupled to the cooler top side, each leg receptacle of the pair of leg receptacles being tubular and oriented parallel to the cooler left side and the cooler right side;

a pair of chair legs, each chair leg having a lower attachment portion, a U-shaped riser portion, and a support portion, the lower attachment portion being horizontal and slidingly engageable within the pair of leg receptacles, the riser portion being pivotably coupled to the support portion and moving between a vertical use position and a horizontal store position, the support portion including a horizontal base section and a back support section, the pair of chair legs in the use position being configured to slidably receive a stadium bench or seat between the lower attachment portion and the base section of the support portion of each chair leg;

a chair bottom coupled to the pair of chair legs, the chair bottom being coupled to the support portion of each chair leg; and a chair back coupled to the pair of chair legs, the chair back having a back frame pivotably coupled to the back support section of the support portion and a back rest coupled to the back frame, the chair back moving between an upright position and a folded position adjacent the chair bottom, the back frame being a squared U-shape.

11. The foldable stadium seat and cooler apparatus of claim 10 further comprising the back support section forming an acute angle with the horizontal base section.

* * * * *